United States Patent [19]

Gordon

[11] 3,937,328

[45] Feb. 10, 1976

[54] SUSPENDED CARTON WITHIN A CARTON

[75] Inventor: Robert Louis Gordon, Monroe, N.Y.

[73] Assignee: International Paper Company, New York, N.Y.

[22] Filed: Sept. 23, 1974

[21] Appl. No.: 508,550

[52] U.S. Cl. ..... 206/521; 229/14 C

[51] Int. Cl.[2] ..... B65D 81/02; B65D 85/30

[58] Field of Search ..... 206/454–456, 206/521, 806; 229/14 R, 14 BE, 14 C, 23 R, 23 BT

[56] References Cited

UNITED STATES PATENTS

| | | | |
|---|---|---|---|
| 2,330,347 | 9/1943 | Elliot | 206/521 X |
| 2,700,460 | 1/1955 | Hoover | 206/521 |
| 3,437,198 | 4/1969 | Vansaun et al. | 206/521 |
| 3,752,301 | 8/1973 | Bluemel | 229/14 C X |
| 3,853,220 | 12/1974 | Luray | 229/14 C X |

*Primary Examiner*—William Price
*Assistant Examiner*—Steven E. Lipman
*Attorney, Agent, or Firm*—Alfred L. Michaelsen

[57] ABSTRACT

A container for packaging fragile items. The container provides an inner carton suspended within an outer carton. The suspension is achieved by means of integral end flaps on the inner carton which interlock the end flaps of the outer carton.

3 Claims, 7 Drawing Figures

SUSPENDED CARTON WITHIN A CARTON

BACKGROUND OF THE INVENTION

This invention pertains to the packaging and material handlng arts and more specifically to a new and useful container for the packaging of fragile items.

Those skilled in the packaging and material handling arts having long recognized a need for a simple container which is useful for packaging fragile items by suspending and thereby mechanically isolating the items from the exterior of the container so that shock and vibration which is suffered by the external container is not also suffered by the fragile item packaged therein.

Various solutions have been proposed for such a problem which range from packing the fragile items in layers of resilient material to providing complicated suspension systems within the package. Providing layers of resilient material has the disadvantage that it adds weight to the package and is wasteful of material. The J. E. Clenny and W. H. Fairchild patent, U.S. Pat. No. 987,958, shows one manner in which cardboard buffers are used to fill in the space between the inner and outer carton and thus shock mount the inner carton.

The Hoover patent, U.S. Pat. No. 2,700,460, and the two Ryno patents, U.S. Pat. Nos. 2,700,518 and No. 2,785,795, show complex systems in which the fragile item is suspended in a flexible tubing which is then twisted at the ends and thereby providing a suspension system. Such systems are too complex to be economical for large volume packaging.

SUMMARY OF THE INVENTION

The primary objective of this invention is to provide a container for packaging fragile items which overcomes the difficulties of the prior art devices. The unique construction of the present invention, which incorporates a carton suspended within a carton by tabs that are integral to the inner carton, provides several advantages.

First, the inner carton is securely suspended and attached to the outer carton by means of a slot and tab thereby requiring only a minimum amount of material for the actual suspension function.

The use of integral tabs allows the suspension system to be formed out of the same blank as the inner carton thereby simplifying assembly of the container.

Also, the unique construction allows the suspension system to be completely assembled at the same time that the package is assembled, i.e., the package requires no further manipulations in order to engage the suspension system aside from the assembly of the cartons themselves.

DETAILED DESCRIPTION OF THE INVENTION

Figure 1:
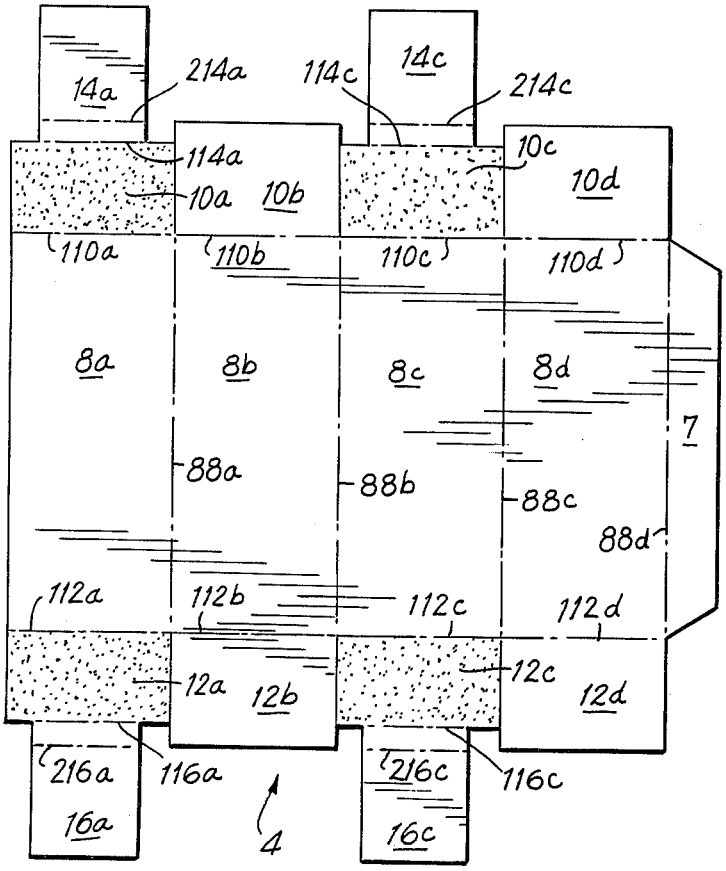
FIG. 1 is a plan view of the blank from which the inner carton is formed.
Figure 3:
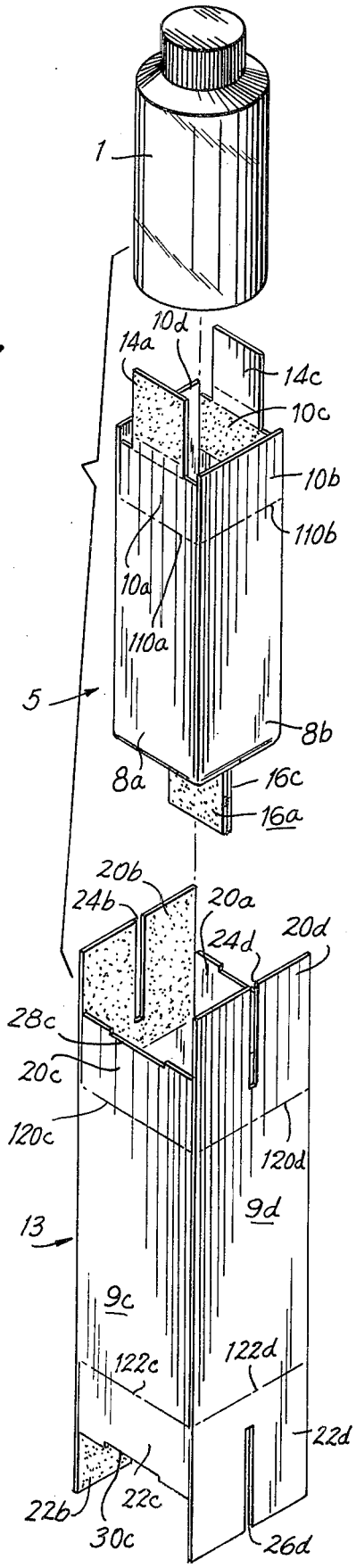
FIG. 3 is an exploded perspective view of a container showing the component parts thereof.

With reference to FIG. 3, in accordance with the instant invention, a container which is suitable for packaging a fragile item 1 comprises an inner carton 5 and outer carton 13. The inner carton 5 is assembled from a blank which is shown in FIG. 1. The blank 4 consists of side wall panels 8*a*, 8*b*, 8*c* and 8*d* hingedly connected to each other at fold lines 88*a*, 88*b* and 88*c*. A sealing tab 7 is hingedly connected to side wall panel 8*d* at fold line 88*d*. The blank 4 also has top wall panels 10*a*, 10*b*, 10*c* and 10*d* which are respectively hinged to side wall panels 8*a*, 8*b*, 8*c* and 8*d* at hinge lines 110*a*, 110*b*, 110*c* and 110*d*. The blank 4 also has bottom wall panels 12*a*, 12*b*, 12*c* and 12*d* which are respectively hinged to side wall panels 8*a*, 8*b*, 8*c* and 8*d* at hinge lines 112*a*, 112*b*, 112*c* and 112*d*. Also, the top panels 10*a* and 10*c* have tabs 14*a* and 14*c* hingedly connected at hinge lines 114*a* and 114*c*. The tabs 14*a* and 14*c* include fold lines 214*a* and 214*c*, the purpose of which will presently appear. The bottom panels 12*a* and 12*c* have tabs 16*a* and 16*c* respectively attached at hinge lines 116*a* and 116*c*. The tabs 16*a* and 16*c* include hinge lines 216*a* and 216*c*, the purpose of which will presently appear.

Figure 2:
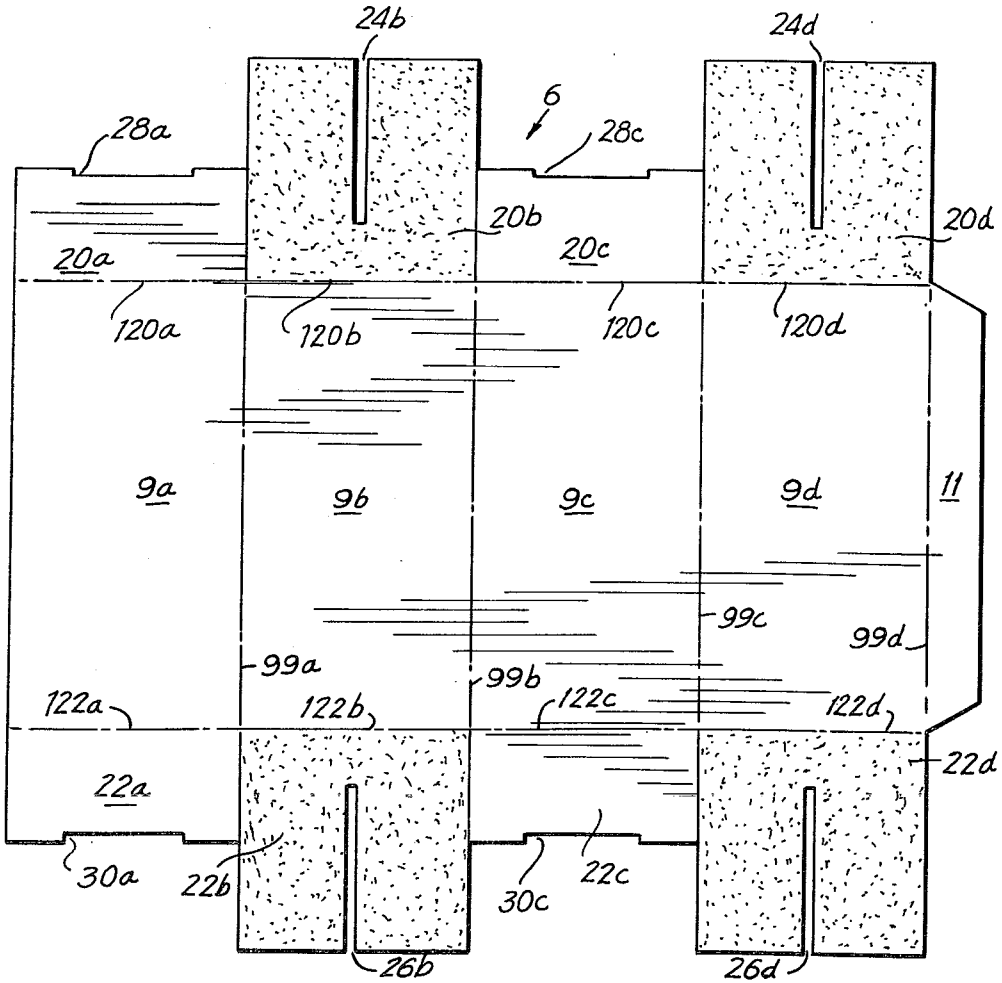
FIG. 2 is a plan view of the blank from which the outer carton is formed.

In reference to FIG. 2, the outer carton 13 is constructed from a blank 6 which has side wall panels 9*a*, 9*b*, 9*c* and 9*d* hingedly connected at fold lines 99*a*, 99*b* and 99*c*. A sealing tab 11 is hingedly connected to side wall panel 9*d* at fold line 99*d*. The blank 6 also has top wall panels 20*a*, 20*b*, 20*c* and 20*d* respectively hinged to side wall panels 9*a*, 9*b*, 9*c* and 9*d* at hinge lines 120*a*, 120*b*, 120*c* and 120*d*. The blank 6 also has bottom wall panels 22*a*, 22*b*, 22*c* and 22*d* which are respectively hinged to side wall panels 9*a*, 9*b*, 9*c* and 9*d* at hinge lines 122*a*, 122*b*, 122*c* and 122*d*. The top wall panels 20*b* and 20*d* and the bottom wall panels 22*b* and 22*d* each respectively have flat shallow slots 24*b*, 24*d*, 26*b* and 26*d* cut therein. Top and bottom wall panels 20*a*, 20*c*, 22*a* and 22*c* each respectively have elongated slots 28*a*, 28*c*, 30*a* and 30*c* cut therein. The purpose of these slots will presently be made apparent.

With reference to FIG. 3, the cartons 5 and 13 are assembled from the two blanks 4 and 6. When the sealing tab 7 of blank 4 is attached by gluing or other suitable means to the inside of side wall 8*a*, the resulting carton 5 takes on a rectangular shape such that the side walls 8*a*, 8*b*, 8*c* and 8*d* are folded to be perpendicular to each other. The same is true with respect to blank 6 when its sealing tab 11 is attached to the inside of side wall 9*a* to form carton 13.

The top flaps 10*b* and 10*d* of carton 5 are folded toward the center of the carton 5 along lines 110*b* and 110*d*. Then, top flaps 10*a* and 10*c* of carton 5 are folded along lines 110*a* and 110*c* respectively so that top flaps 10*a* and 10*c* overlap top flaps 10*b* and 10*d* and are glued thereto. In the process of folding top flaps 10*a* and 10*c*, tabs 14*a* and 14*c* are folded outwardly so that tabs 14*a* and 14*c* are abutting and are congruent to each other. The same operation is repeated in folding the bottom flaps of carton 5.

Figure 4:
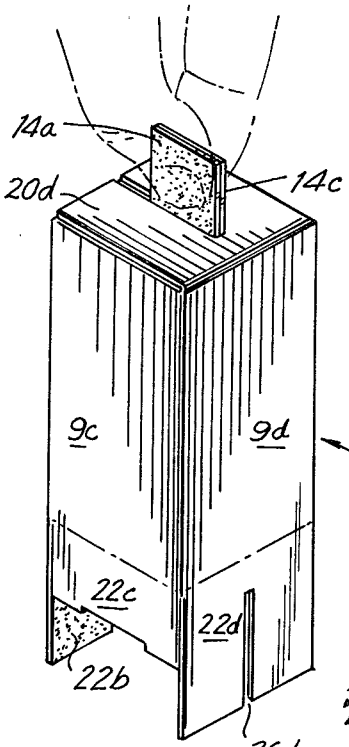
FIG. 4 is a perspective view of a partially formed container showing the upper end with the tab of the inner container protruding through a slot in the outer container.
Figure 5:
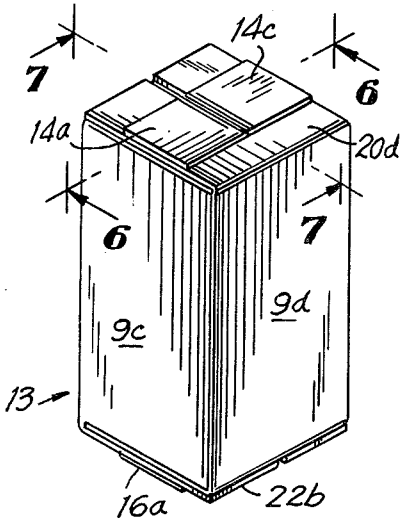
FIG. 5 is a perspective view of a container showing the container with the upper tabs bent over to engage the end portion of the outer container.

With respect to carton 13, top flaps 20*c* and 20*a* are initially folded along lines 120*a* and 120*c* so that slots 24*a* and 24*c* are adjacent thereby forming a single slot. Next, top flap 20*b* is folded along fold line 120*b* so as to overlap flaps 20*a* and 20*c*, and flap 20*b* is glued to flaps 20*a* and 20*c*. Top flap 20*d* is then folded along fold line 120*d* to overlap top flaps 20*b*, 20*a* and 20*c* and is glued to flap 20*b*. The inner carton 5 is then inserted through the open bottom end of the outer carton 13 and the congruent tabs 14*c* and 14*a* extend through the slot formed by overlying slots 24*a*, 24*c*, 26*a* and 26*c* in the top end of the carton 13 as shown in FIG. 4. The flaps 14*a* and 14*c* are then bent outwardly along fold lines 214*a* and 214*c* respectively and can be glued to the surface of flap 20*d* as indicated in FIG. 5. The bottom end of outer carton 13 is then folded so that the tabs 16*c* and 16*a* are congruent and similarly protrude through the slot formed by 26*b*, 26*d*, 30*a* and 30*c*. The tabs 16*a* and 16*c* are then folded back along fold lines 216*a* and 216*c* so that they lay flat and can be glued to the bottom flap 22*b*.

Figure 6:
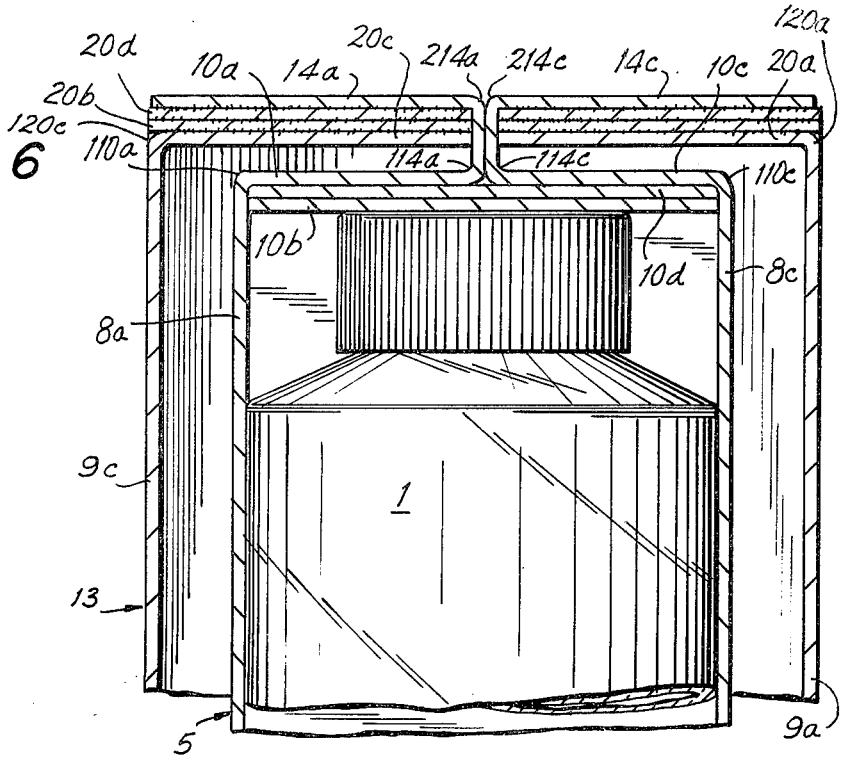
FIG. 6 is a sectional view taken along line 6—6 of FIG. 5.
Figure 7:
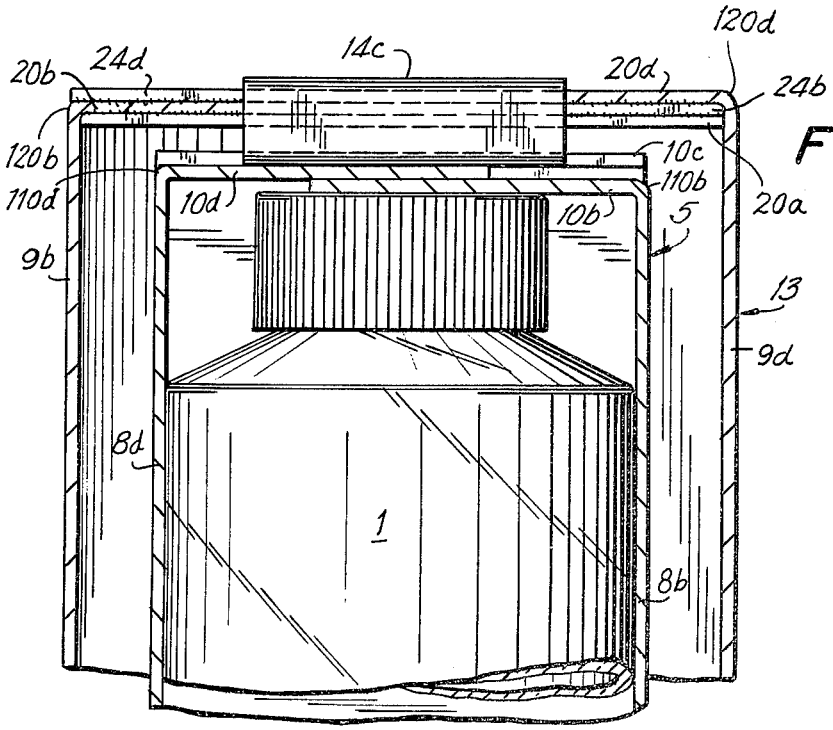
FIG. 7 is a sectional view taken along line 7—7 of FIG. 5.

With reference to FIGS. 6 and 7, it can be seen that the fragile item 1 is completely sealed within the inner carton 5, and the carton 5 is completely isolated from carton 13 by an air space around the top and sides and bottom except for those portions of tabs 14*a* and 14*c* which lie between fold lines 214*a* and 114*a* and 214*c* and 114*c* respectively. In this manner, the carton 5 is suspended from both the top and the bottom of the outer carton 13 and is, therefore, mechanically shock mounted.

What is claimd is:

1. A package which comprises a sealed first carton of foldable material and having side walls and end flaps foldably connected thereto, a sealed second carton surronding said first carton, said second carton of foldable material and having side walls and end flaps foldably connected thereto, connecting tabs foldably connected to opposite end flaps of said first carton, portions of said connecting tabs congruently abutting each other, said second carton having aligned slotted portions in the end flaps thereof, said portions of connecting tabs congruently abutting each other extending through said aligned slotted portions and the terminal portions of said connecting tabs folded to lay within a parallel plane to the end flaps of said second carton and attached thereto.

2. A package according to claim 1 which consists essentially of two unitary pieces of folded material.

3. A package according to claim 1 wherein said terminal portions of said connecting tabs are secured on the external surface of said second carton.

* * * * *